US010926980B2

(12) United States Patent
Beyersdorff

(10) Patent No.: US 10,926,980 B2
(45) Date of Patent: Feb. 23, 2021

(54) DRIVE DEVICE FOR THE SPOOL OF A WINCH

(71) Applicant: ROTZLER HOLDING GMBH + CO. KG, Steinen (DE)

(72) Inventor: Stefan Beyersdorff, Steinen (DE)

(73) Assignee: ROTZLER HOLDING GMBH + CO. KG, Steinen (DE)

( * ) Notice: Subject to any disclaimer, the term of this patent is extended or adjusted under 35 U.S.C. 154(b) by 149 days.

(21) Appl. No.: 16/082,279

(22) PCT Filed: Mar. 6, 2017

(86) PCT No.: PCT/EP2017/000298

§ 371 (c)(1),
(2) Date: Jan. 6, 2019

(87) PCT Pub. No.: WO2017/153043

PCT Pub. Date: Sep. 14, 2017

(65) Prior Publication Data

US 2019/0161327 A1 May 30, 2019

(30) Foreign Application Priority Data

Mar. 5, 2016 (DE) ..... 10 2016 002 798.3

(51) Int. Cl.
*B66D 1/20* (2006.01)
*B66D 1/12* (2006.01)
*B66D 1/22* (2006.01)

(52) U.S. Cl.
CPC ..... *B66D 1/12* (2013.01); *B66D 1/20* (2013.01); *B66D 1/225* (2013.01)

(58) Field of Classification Search
CPC ... B66D 1/12; B66D 1/14; B66D 1/16; B66D 1/18; B66D 1/20; B66D 1/225; F16H 9/10
See application file for complete search history.

(56) References Cited

U.S. PATENT DOCUMENTS 1,999,202 A * 4/1935 Osgood ..... B66D 1/14 254/346
2,348,382 A * 5/1944 Halby ..... B66D 1/14 254/355

(Continued)

FOREIGN PATENT DOCUMENTS

CN 102 132 061 7/2011
DE 736 650 6/1943

(Continued)

*Primary Examiner* — Sang K Kim
*Assistant Examiner* — Nathaniel L Adams
(74) *Attorney, Agent, or Firm* — Gudrun E. Huckett

(57) ABSTRACT

The invention relates to a drive device (1) for the spool (6) of a winch. The drive device (1) comprises a drive motor (2) having a drive shaft (5), a transmission (3) and an output shaft (4) that drives a spool (6). The transmission has a first drive connection (10) between the drive shaft (5) of the drive motor (2) and the output shaft (4) to the spool (6). The first drive connection (10) drives the output shaft (4) over a first rotational speed range (DB1) in a first gear. According to the invention, a second drive connection (30) is provided between the drive motor (2) and the output shaft (4), wherein the second drive connection (30) drives the output shaft (4) over a second rotational speed range (DB2) in a second gear. The second drive connection (30) is designed to be separate from the first drive connection (10) as a parallel drive path, and is driven by the drive motor (2) together with the first drive connection (10). If the output shaft (4) is driven by the second drive connection (30), the power flow of the first drive connection (10) from the drive shaft (5) to the output shaft (4) is interrupted.

17 Claims, 3 Drawing Sheets

(56) References Cited

U.S. PATENT DOCUMENTS

| | | | | |
|---|---|---|---|---|
| 7,951,027 | B2 * | 5/2011 | An | F16H 9/10 474/47 |
| 8,852,040 | B2 | 10/2014 | Gebhart | |

FOREIGN PATENT DOCUMENTS

| | | |
|---|---|---|
| DE | 38 28 205 | 12/1989 |
| DE | 10 2012 200 035 | 7/2013 |

* cited by examiner

DRIVE DEVICE FOR THE SPOOL OF A WINCH

BACKGROUND OF THE INVENTION

The invention concerns a drive device for the spool of a winch.

Drive devices for the spool of a winch are known in general. They comprise a drive motor with a drive shaft, a transmission, and an output shaft driving the spool. The transmission comprises a drive connection between the drive shaft of the drive motor and the output shaft to the spool. By a transmission ratio, the output shaft will be driven in a predetermined rotational speed range.

For pulling a load, a low rotational speed at high torque is expedient. The drive connection between the drive shaft of the drive motor and the output shaft of the transmission is therefore appropriately configured.

In order to wind a withdrawn pull rope onto the spool, a slow controlled pulling action is desired, depending on the pulling condition or tensile load. When greater pulling travels exist and smaller pulling loads are applied, a fast pulling action is desired. Therefore, the drive devices of winches are often provided with a slow and a fast gear. For changing the rotational speed, e.g. switching motors such as axial piston motors with adjustable swash plate but also two motors in parallel arrangement are used. This configuration of winches is expensive. Even though the rotational speed of the spool can be varied in accordance with the user's desire by selection of the drive motors, the switching ratio between the low gear and the fast gear remains the same. Since hydraulic motors can be operated only within a limited rotational speed spectrum with good efficiency, a reduction in the winch power will result for other switching ratios.

The invention has thus the object to provide a drive device for the spool of a winch that, for same driving rotational speeds of the drive motor, enables with only one drive unit an operation of the spool by a slow pulling gear or by a fast pulling gear, whereby switching should be possible without opening the drive connection between spool and drive motor or interrupting or stopping the pulling movement.

SUMMARY OF THE INVENTION

This object is solved according to the invention in that the transmission comprises a second drive connection between the drive motor and the output shaft, wherein the second drive connection drives the output shaft across a second rotational speed range in a second gear, in that the second drive connection is embodied separate from the first drive connection as a parallel drive path and both drive connections are driven together by the drive shaft of the drive motor, and in that, when driving the output shaft through the second drive connection, the first drive connection continues to be switched on but the force flow of the first drive connection from the drive shaft to the output shaft is interrupted.

The transmission is configured with a second drive connection between the drive motor and the drive shaft, wherein the second drive connection is designed such that the spool can be driven in a second rotational speed range. The second drive connection is embodied separate from the first drive connection and forms a parallel drive path that can be switched on and off without interruption of the first drive path. Both drive connections are driven together by the drive shaft of the drive motor. When the second drive connection is active and when the output shaft is driven by the second drive connection in the second gear, the force flow of the first drive connection from the drive shaft to the output shaft is interrupted. The first drive connection remains however switched on so that upon opening of the second drive connection the force flow through the first drive connection to the output shaft is closed again.

Every time the second drive connection is switched active and the spool is driven in fast gear, only the force flow of the first drive connection is interrupted; the mechanical connection between the drive shaft and the output shaft remains intact however. Accordingly, despite the drive action by the common drive shaft of the only drive motor and continued closed first drive connection, an operation of the spool in fast gear through the second drive connection can be ensured. Forgoing the use of several individual motors or switching motors for driving the spool at different rotational speeds saves technical and economic expenditure.

Due to the configuration of the drive device according to the invention, it is ensured that in case of a faulty second drive connection, for example, in case of a break of the second drive connection, the load cannot slide off because, as the spool is slowing down, the still existing first drive connection is active and holds the load. Thus, when the rotational speed of the output shaft returns to the first rotational speed range, the first drive connection—without the user having to take action—becomes active.

The configuration of the drive device according to the invention enables for any momentary driving rotational speed of the drive motor to operate the spool in a slow pulling gear or in a fast gear. Switching gears, i.e., switching on the second drive connection, is carried out without opening the first drive connection between spool and drive motor so that no interruption or stopping of the pulling movement occurs.

Expediently, the first drive connection or the second drive connection is in torque-transmitting connection with the output shaft of the drive device.

Due to the special configuration of the drive device with two parallel drive connections with different transmission ratios, a switching ratio between the first drive connection and the second drive connection is achieved that, when switching on the second drive connection, comprises a first value at a first switching point and a second value at another second switching point. The switching ratio between the first drive connection and the second drive connection is advantageously adjustable in a wide range solely by the selection of e.g. pulley diameters and/or e.g. by the selection of the gear wheels meshing with each other. Since the switching ratio can be configured in a simple way by the selection of e.g. the corresponding pulley diameters or the employed gear wheels, the remaining transmission construction can remain unchanged. The main construction and the spatial dimensions of the transmission remain unchanged when changing the switching ratio.

According to the invention, the first drive connection expediently comprises a freewheel clutch which is active when the output shaft is driven by the second drive connection at higher rotational speed. The freewheel clutch enables a faster rotational speed of the output shaft through the second drive connection without the first drive connection having to be mechanically opened. Only the force flow is interrupted. When the second drive connection is interrupted, the rotational speed of the output shaft drops until the force flow of the first drive connection to the output shaft engages again and the output shaft is again driven through the first drive connection; the freewheel clutch closes on the output shaft in drive direction of the first drive connection.

Expediently, the drive connection is comprised of a first drive wheel, an intermediate wheel, and a first output wheel interacting with the output shaft. In this context, the first drive connection and/or the second drive connection can be embodied as a gear mechanism. The drive wheel, the intermediate wheel, and the output wheel are thus configured as gear wheels.

When the second drive connection is embodied as a gear mechanism, the intermediate wheel of the gear mechanism is expediently supported on the intermediate shaft. In the embodiment of a first drive connection, a first intermediate wheel is fixedly connected to the intermediate shaft and a second intermediate wheel is secured by a freewheel clutch on the intermediate shaft. The output wheel of the first drive connection is fixedly secured on the output shaft.

In a special configuration of the invention, the second drive connection is a belt drive with at least a single stage. The belt of the belt drive wraps around a drive pulley connectable to the drive shaft and an output pulley which is connected fixedly to the output shaft.

Advantageously, the belt drive is embodied as an adjustable belt drive. In a simple embodiment, at least the drive pulley and/or the output pulley can be designed as a belt pulley which is adjustable in regard to diameter.

BRIEF DESCRIPTION OF THE DRAWINGS

Further features of the invention result from the additional claims, the description, and the drawing in which embodiments of the invention described in the following in detail are illustrated. It is shown in:

DESCRIPTION OF PREFERRED EMBODIMENTS

The schematically illustrated drive device 1 for a winch comprises a drive motor 2 which can be embodied as an electric motor, hydraulic motor or a similar drive motor.

Figure 2:
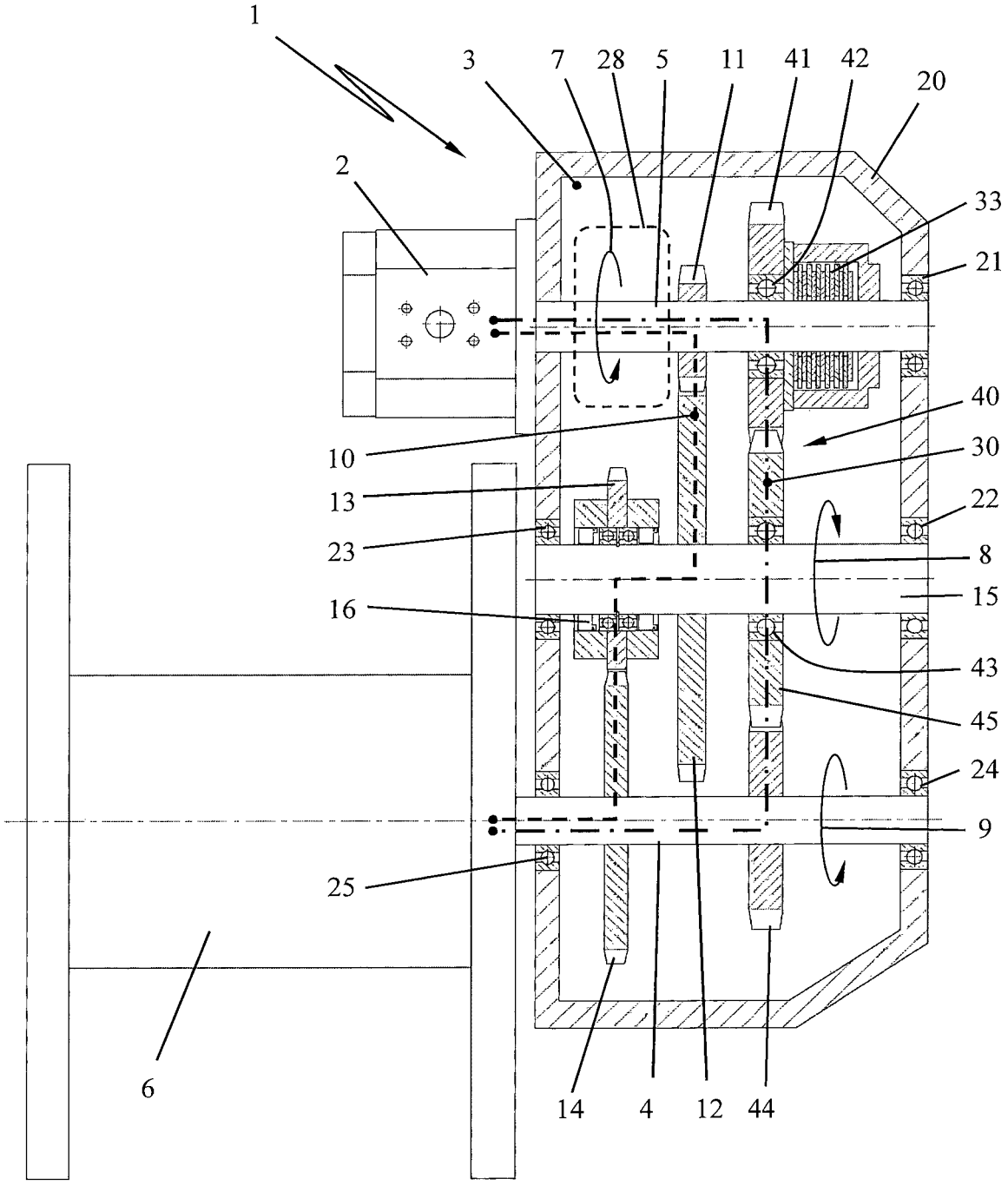
FIG. 2 in schematic illustration a drive device for a spool in a second embodiment.
Figure 3:
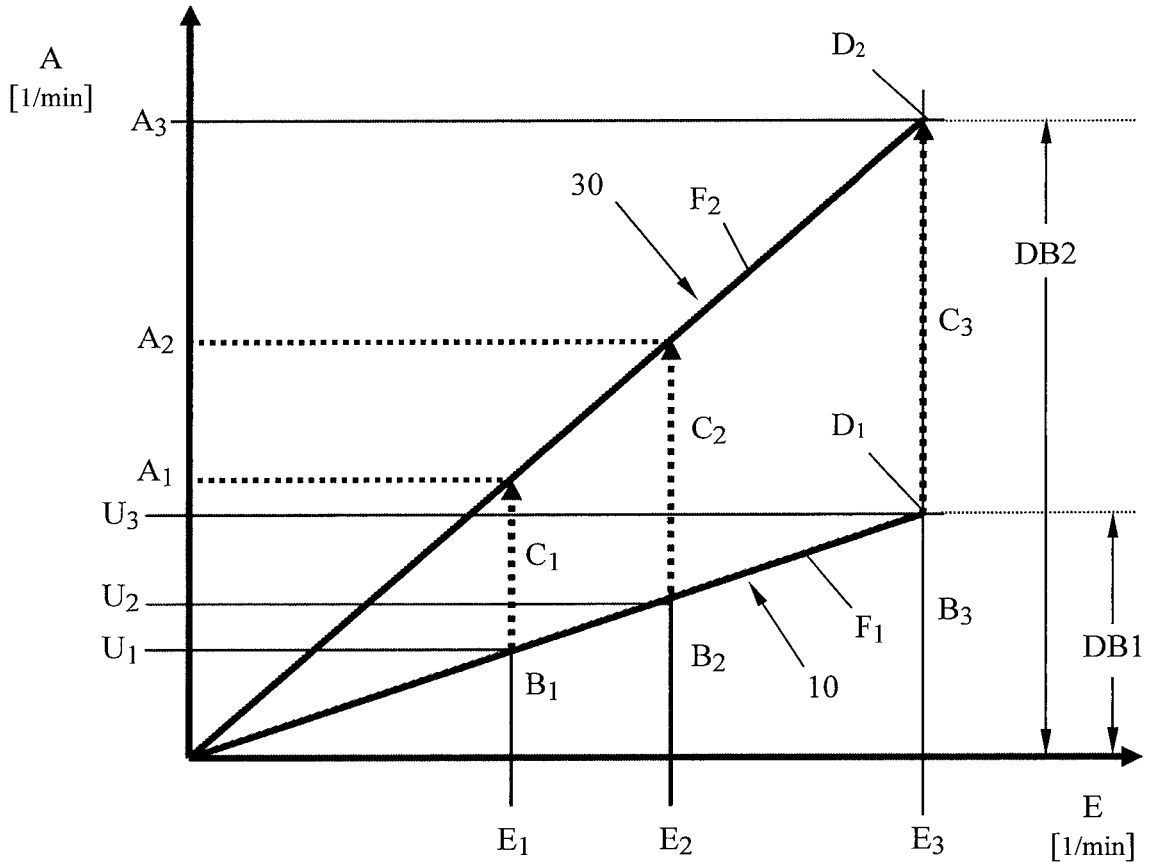
FIG. 3 a schematic diagram in regard to the operation of the drive device according to the invention.

The drive shaft 5 of the drive motor 2 forms the input shaft of a transmission 3 which is driven at an input rotational speed E (FIG. 3). The output shaft of the transmission 3 is formed by an output shaft 4 which is rotating at an output rotational speed A (FIG. 3). The output shaft 4 drives a spool 6 of a winch (FIGS. 1 and 2) in a way not illustrated in detail.

The transmission 3 comprises a first drive connection 10 between the drive shaft 5 of the drive motor 2 and the output shaft 4 to the spool 6 as a first gear with a first transmission ratio $F_1$ (FIG. 3).

Figure 1:
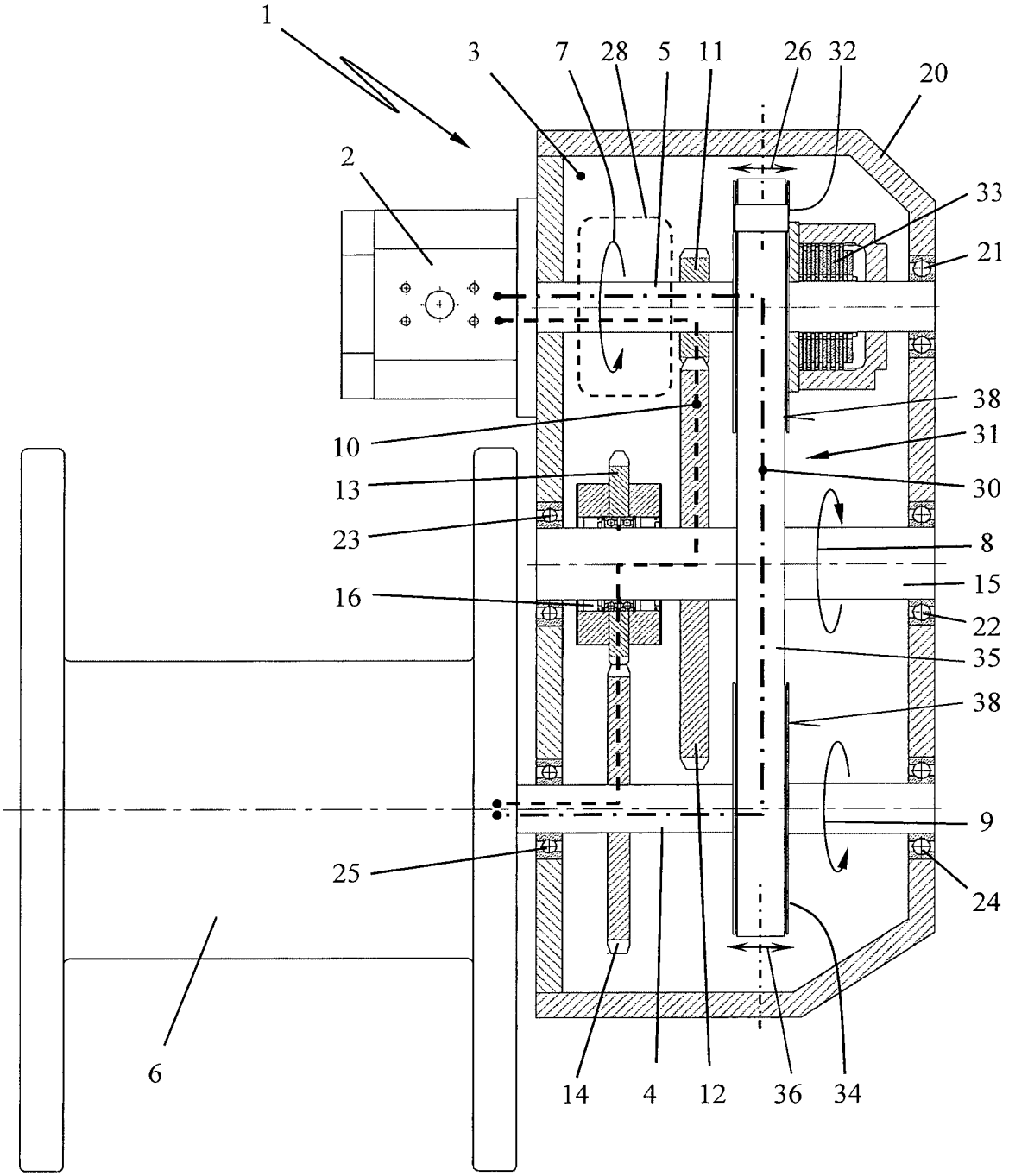
FIG. 1 in schematic illustration a drive device for a spool in the first embodiment.

In the embodiment according to FIG. 1, the first drive connection is comprised of a first drive wheel 11, a first output wheel 14 as well as at least one intermediate wheel 12 or second intermediate wheel 13, arranged between the drive wheel 11 and the output wheel 14. In the illustrated embodiment, the first intermediate wheel 12 is fixedly secured to an intermediate shaft 15; the intermediate shaft 15 rotates in opposite rotational direction 8 relative to the rotational directions 7 and 9 of drive shaft 5 and output shaft 4.

The second intermediate wheel 13 is secured by a freewheel clutch 16 on the intermediate shaft 15. When the intermediate shaft 15 rotates in rotational direction 8, the freewheel clutch 16 closes and produces a torque-transmitting connection to the first output wheel 14. When the output wheel 14 secured fixedly on the output shaft 4 drives the intermediate wheel 13 in rotational direction 9 faster than the intermediate shaft 15, the freewheel clutch 16 becomes active and interrupts the force flow from the drive shaft 5 to the output shaft 4.

In the embodiment according to FIG. 1, the first drive connection 10 is formed as a gear mechanism. The first drive wheel 11, the first and second intermediate wheels 12 and 13, and the first output wheel 14 are embodied as gear wheels.

The first drive wheel 11 is fixedly connected to the drive shaft 5 and meshes with the first intermediate wheel 12. The first intermediate wheel 12 is fixedly secured on the intermediate shaft 15. By means of the intermediate shaft 15 and the freewheel clutch 16, the second intermediate wheel 13 is driven which is meshing with the first output wheel 14. The first output wheel 14 is fixedly secured on the output shaft 4.

As illustrated in dashed lines in FIG. 1, the first output wheel 11, the first and second intermediate wheels 12 and 13 together with the freewheel clutch 16 and the first output wheel 14 form the first drive connection 10 with the transmission ratio $F_1$.

The first drive connection 10 is driven permanently by the rotating drive shaft 5 of the drive motor 2. The force flow in the direction of the dashed line from the drive shaft 5 to the output shaft 4 is canceled when the output wheel 14 of the output shaft 4 rotates the intermediate wheel 13 in rotational direction 8 faster than the intermediate shaft 15 is rotating. When the output wheel 14 of the output shaft 4 drives the intermediate wheel 13 in rotational direction 8 faster than the intermediate shaft 15, the freewheel clutch 16 becomes active; the second intermediate wheel 13 rotates in rotational direction 8 faster than the intermediate shaft 15.

In addition to the first drive connection 10 between the drive shaft 5 and the output shaft 4 with the transmission ratio $F_1$, a second drive connection 30 with transmission ratio $F_2$ is provided as a second gear. As shown in FIG. 3, the transmission ratio $F_2$ is steeper or greater than the transmission ratio $F_1$ of the first drive connection 10.

In the illustrated embodiment according to FIG. 1, the second drive connection 30 with a transmission ratio $F_2$ is configured as a belt drive 31. In the embodiment, a single-stage belt drive is provided; a multi-staged belt drive may be expedient also.

In an embodiment of the invention, the belt drive 31 can be designed as an adjustable belt drive. In a simple embodiment, the drive pulley 32 and/or the output pulley 34 is configured as a belt pulley 38 with adjustable diameter. As illustrated by double arrows 26 and 36, the adjustable belt pulley 38 is composed of two pulley halves that are axially adjustable relative to each other. When the pulley halves are adjusted by enlarging their spacing, the effective diameter of the belt pulley 38 becomes smaller. Accordingly, the effective diameter of the belt pulley 38 becomes larger when the pulley halves are moved toward each other. In this way, a variable transmission ratio of the belt drive 31 can be achieved.

The belt drive 31 is comprised of a drive pulley 32 which is to be coupled by coupling 33 to the drive shaft 5. The driving belt pulley, i.e., the drive pulley 32, has correlated therewith an output pulley 34 which is fixedly secured on the output shaft 4 in the illustrated embodiment. The output belt pulley, i.e., the output pulley 34, is connected to the drive pulley 32 by a belt 35 wherein the belt 35 wraps around the drive pulley 32 and the output pulley 34. The arrangement of a belt tensioning device may be expedient, in particular when an adjustable belt drive is used.

When the coupling 33 is engaged, the drive pulley 32 is entrained by the drive shaft 5 in rotation and drives the belt drive 31. The belt 35 acts immediately on the output pulley 34 which is connected fixedly to the output shaft 4. The rotational speed of the drive shaft 5 is thus transmitted—by means of the belt drive 31—with a transmission ratio $F_2$ (FIG. 3) to the output shaft 4.

The first drive connection 10 as well as the second drive connection 30 of the transmission 3 are arranged in a common housing 20, wherein the drive shaft 5 is supported by a drive bearing 21 in the housing 20.

Correspondingly, the intermediate shaft 15 is supported at its ends by a first intermediate bearing 22 and a second intermediate bearing 23 in the housing 20 of the transmission 3. The output shaft 4 is supported at its first end by an output bearing 24 and in its other end section by an output bearing 25 in the housing 20 of the transmission 3.

In operation of the drive device 1, in a first rotational speed range DB1 (FIG. 3) of the output shaft 4 from zero to a maximum rotational speed $D_1$, the drive action can be realized—as shown in FIG. 3—exclusively by the first drive connection 10 with the transmission ratio $F_1$. The drive shaft 5 rotating in rotational direction 7 drives the drive wheel 11 which meshes with the intermediate wheel 12 and rotates the intermediate shaft 15 in rotational direction 8. The freewheel clutch 16 closes and transmits the rotational movement of the intermediate shaft 15 to the intermediate wheel 13 which drives the output wheel 14 and the output shaft 4. When the drive motor 2 stops, a suspended load will attempt to rotate the support shaft 4 opposite to the rotational direction 9. In this opposite rotational direction, the freewheel clutch 16 closes so that an interruption-free support of the load up to the drive shaft 5 is provided. Expediently, a brake 28 is provided which engages the drive shaft 5 and by means of which a load can be safely held, even in case of failure of the drive motor 2.

When the drive motor 2 accelerates, the rotational speed of the output shaft 4 increases according to the transmission ratio $F_1$ in FIG. 3. The spool 6 rotates for a slower controlled pulling action at low rotational speed. When a fast pulling action is desired, the rotational speed of the output shaft 4 and thus of the spool 6 can be increased at any time in that the second drive connection 30, namely the belt drive 31, with the transmission ratio $F_2$ is switched on. In FIG. 3, random switching points $U_1$, $U_2$, and $U_3$ are represented at which point a user selectively can drive the output shaft 4 by means of the first drive connection 10 with slow pulling action or by means of the second drive connection 30 with fast pulling action.

The first drive connection 10 with the transmission ratio $F_1$ forms the first gear of the drive device 1 for the spool 6; the second drive connection 30 with the transmission ratio $F_2$ forms the second gear with higher rotational speed and fast pulling action.

When the drive pulley 32 is connected fixedly to the drive shaft 5 at a random switching point $U_1$, $U_2$, and $U_3$ by closing the coupling 33, then the belt 35 drives the output shaft 4 at higher rotational speed than the first drive connection 10. The second drive connection 30 with the transmission ratio $F_2$ drives the output shaft 4 in a second rotational speed range DB2; the first rotational speed range DB1 of the first drive connection 10 forms a lower range of the second rotational speed range DB2. As illustrated in FIG. 3, both drive connections 10, 30 cover the first rotational speed range DB1 up to the first maximum rotational speed $D_1$. Only the second drive connection 30 covers the entire second rotational speed range DB2 up to a maximum rotational speed $D_2$.

During the switching process, by means of slipping of the coupling 33 a lower speed than the final speed of the second gear can be achieved. This is possible only with the torque of the second gear. Since the non-transmitted power in the coupling 33 is lost as heat, slipping of the coupling 33 is expedient only for a short period of time, i.e., if possible only in the switching phase. Expediently, a slipping coupling 33 should not be provided as a permanent state.

Independent of the input rotational speed E, when the second drive connection 30 is switched on at a random switching point $U_1$, $U_2$, and $U_3$, i.e., drive pulley 32 is engaged, the output shaft 4 will rotate faster than when driven by the drive connection 10. The output wheel 14, coupled fixedly with the output shaft 4, of the second drive connection 30 drives therefore the intermediate wheel 13 faster than the first drive connection 10 drives the intermediate shaft 15; therefore, the second intermediate wheel 13 will "outpace" the intermediate shaft 15 in rotational direction 8. The freewheel clutch 16 will become active; the second drive connection 30 is not impaired by the still connected first drive connection 10. Only the driving torque of the first drive connection 10 is no longer transmitted to the output shaft 4; the drive connection 10 itself continues to be connected.

At the switching point $U_1$, the output shaft 4 is driven with a slow rotational speed for a slow controlled pulling action at an input rotational speed $E_1$ of the drive connection 10 with the transmission ratio $B_1$. When a switch to the second drive connection 30 occurs by closing the coupling 33, the output shaft 4 is driven at the input rotational speed $E_1$ of the drive connection 30 with the transmission ratio $F_1$ at the rotational speed $A_1$ for a fast pulling action. In this context, by means of the freewheel clutch 16 it is ensured that, without impairment by the still closed first drive connection 10, the output shaft 4 can rotate at higher rotational speed than the rotational speed made possible by the driving drive connection 10.

The switching ratio at the switching point U results from the quotient C/B. The switching ratios C1/B1, C2/B2, C3/B3 at the switching points $U_1$, $U_2$, and $U_3$ can be switched by the switching coupling at all input rotational speeds. Constructively, the switching coupling 33 can also be arranged at the output shaft 4; this provides constructively a compact configuration of the transmission housing with a reduced transmission depth.

When in case of a failure e.g. the belt 35 of the second drive connection 30 should break and the drive connection 30 be interrupted, the suspended load will try to rotate the output shaft 4 opposite to the rotational direction 9. While at a high rotational speed in rotational direction 9 the freewheel clutch 16 is active, the freewheel clutch will close opposite to the rotational direction 9 and provide a fixed connection between the output wheel 14, the second intermediate wheel 13, the freewheel clutch 16, and the intermediate shaft 15 so that the suspended load will try to rotate the intermediate shaft 15 opposite to the rotational direction 8. Since the intermediate shaft 15 is fixedly connected by means of the first intermediate wheel 12 to the drive wheel 11 and the drive shaft 5, e.g. the load can be held by means of the brake 28 at the drive shaft 5. Thus, a safe operation is possible even in case of failure.

The embodiment according to FIG. 2 corresponds in its basic configuration to that of FIG. 1, for which reason same parts are provided with same reference characters.

While in the embodiment according to FIG. 1 the second drive connection 30 is formed by a belt drive 31, in the embodiment according to FIG. 2 the second drive connection 30 of the fast gear is formed by the gear mechanism 40. The second drive wheel 41 embodied as a gear wheel of the second drive connection 30 is secured by a bearing 42 on the drive shaft 5. By means of the coupling 33, the second drive wheel 41 of the second drive connection 30 can be coupled fixedly with the drive shaft 5.

The second drive wheel 41 of the second drive connection 30 meshes with an intermediate wheel 45, embodied as a gear wheel, of the second drive connection 30 that is secured by means of a bearing 43 so as to be freely rotatably supported on the intermediate shaft 15. The third intermediate wheel 45 of the second drive connection 30 meshes with a second output wheel 44, embodied as a gear wheel, of the second drive connection 30 which is fixedly coupled with the output shaft 4.

The first drive connection 10 is of the same configuration as described in the embodiment according to FIG. 1.

In the embodiment according to FIG. 2, the first drive connection 10 is also embodied for a rotational speed range DB1 of the output shaft 4 up to a maximum rotational speed $D_1$. When the second drive wheel 41 of the second drive connection 30 is coupled by means of the coupling 33 fixedly with the drive shaft 5, by means of the drive wheel pairs 41/44/45 the output shaft 4 is driven at higher rotational speed according to the transmission ratio $F_2$ of the second drive connection 30. The second drive connection 30 is embodied for a rotational speed range DB2 up to a maximum rotational speed $D_2$.

The first drive connection 10 from the drive shaft 5 through the first drive wheel 11, the first and second intermediate wheels 12 and 13, and the first output wheel 14 is still closed wherein the higher rotational speed in rotational direction 9 rotates the second intermediate wheel 13 faster than it is driven by the intermediate shaft 15. The second intermediate wheel 13 "outpaces" the intermediate shaft 15; the freewheel clutch 16 opens. The force flow of the first drive connection 10 to the output shaft 4 is interrupted.

The features and advantages described in connection with the first embodiment can be utilized advantageously also in connection with the second embodiment. The same holds true for the features and advantages described in connection with the second embodiment which can also be utilized in the first embodiment.

What is claimed is:

1. A drive device for a spool of a winch, the drive device comprising:

a drive motor comprising a drive shaft;

a transmission;

an output shaft configured to drive the spool;

wherein the transmission comprises a first drive connection operatively connecting the drive shaft of the drive motor to the output shaft, wherein the first drive connection is a first drive path driving the output shaft across a first rotational speed range in a first gear;

wherein the transmission comprises a second drive connection operatively connecting the drive motor to the output shaft, wherein the second drive connection drives the output shaft across a second rotational speed range in a second gear;

wherein the second drive connection is embodied separate from the first drive connection as a second drive path parallel to the first drive path;

wherein the first and the second drive connections are driven together by the drive shaft of the drive motor;

wherein, when the second drive connection drives the output shaft, the first drive connection continues to be switched on but a force flow of the first drive connection from the drive shaft to the output shaft is interrupted;

wherein the second drive connection forming the second drive path is configured to be switched on and off independent of a load acting on the output shaft so that, for any momentary driving rotational speed of the drive motor, the spool is operable in a slow pulling gear or in a fast gear;

wherein the first drive connection comprises a freewheel clutch, wherein the freewheel clutch opens when the second drive connection is switched on.

2. A drive device for a spool of a winch, the drive device comprising:

a drive motor comprising a drive shaft;

a transmission;

an output shaft configured to drive the spool;

wherein the transmission comprises a first drive connection operatively connecting the drive shaft of the drive motor to the output shaft, wherein the first drive connection is a first drive path driving the output shaft across a first rotational speed range in a first gear;

wherein the transmission comprises a second drive connection operatively connecting the drive motor to the output shaft, wherein the second drive connection drives the output shaft across a second rotational speed range in a second gear;

wherein the second drive connection is embodied separate from the first drive connection as a second drive path parallel to the first drive path;

wherein the first and the second drive connections are driven together by the drive shaft of the drive motor;

wherein, when the second drive connection drives the output shaft, the first drive connection continues to be switched on but a force flow of the first drive connection from the drive shaft to the output shaft is interrupted;

wherein the second drive connection comprises a drive pulley and a switching coupling, wherein the switching coupling is configured to couple the drive pulley to the drive shaft, wherein the switching coupling comprises an engaged state and in the engaged state the drive shaft is fixedly connected to the drive pulley to rotate the drive pulley, wherein the switching coupling comprises a disengaged state and in the disengaged state the drive shaft is neither fixedly connected nor connected with slip to the drive pulley;

wherein the second drive connection forming the second drive path is switched on in the engaged state of the switching coupling and switched off in the disengaged state of the switching coupling so that, for any momentary driving rotational speed of the drive motor, the spool is operable in a slow pulling gear or in a fast gear;

wherein the first drive connection comprises a freewheel clutch, wherein the freewheel clutch opens when the second drive connection is switched on.

3. The drive device according to claim 2, wherein the first drive connection or the second drive connection is selectively providing a torque-transmitting connection to the output shaft.

4. The drive device according to claim 2, wherein a switching ratio between the first drive connection and the second drive connection is adjustable.

5. The drive device according to claim 4, wherein the switching ratio is configured to be changed without changing a construction of the transmission.

6. The drive device according to claim 2, wherein the first drive connection comprises a first drive wheel acting through at least one intermediate wheel on a first output wheel interacting with the output shaft.

7. The drive device according to claim 6, wherein at least one of the first drive connection and the second drive connection is a gear mechanism.

8. The drive device according to claim 6, wherein the first drive wheel, the at least one intermediate wheel, and the first output wheel are gear wheels.

9. The drive device according to claim 6, wherein the at least one intermediate wheel is supported on an intermediate shaft.

10. The drive device according to claim 9, wherein the at least one intermediate wheel includes a first intermediate wheel fixedly secured on the intermediate shaft and a second intermediate wheel secured by a freewheel clutch on the intermediate shaft.

11. The drive device according to claim 6, wherein the first output wheel is fixedly secured on the output shaft.

12. The drive device according to claim 2, wherein the second drive connection is a belt drive comprising at least a single stage.

13. The drive device according to claim 12, wherein the belt drive comprises the drive pulley connectable to the drive shaft and an output pulley fixedly connected to the output shaft, wherein a belt of the belt drive wraps around the drive pulley and the output pulley.

14. The drive device according to claim 13, wherein the belt drive is an adjustable belt drive.

15. The drive device according to claim 14, wherein the drive pulley is a diameter-adjustable belt pulley.

16. The drive device according to claim 14, wherein the output pulley is a diameter-adjustable belt pulley.

17. The drive device according to claim 14, wherein the drive pulley and the output pulley are diameter-adjustable belt pulleys.

* * * * *